US006975562B2

(12) United States Patent
Lizzi

(10) Patent No.: US 6,975,562 B2
(45) Date of Patent: Dec. 13, 2005

(54) WEARABLE ELECTRONIC DEVICE WITH MODE OPERATION INDICATOR

(75) Inventor: Ronald S. Lizzi, Bethany, CT (US)

(73) Assignee: Timex Group B.V., (NL)

( * ) Notice: Subject to any disclaimer, the term of this patent is extended or adjusted under 35 U.S.C. 154(b) by 0 days.

(21) Appl. No.: 10/730,200

(22) Filed: Dec. 5, 2003

(65) Prior Publication Data

US 2005/0122845 A1 Jun. 9, 2005

(51) Int. Cl.[7] ..... G04C 17/00; G04B 19/04; G04B 25/00

(52) U.S. Cl. ..... 368/69; 368/80; 368/223; 368/228

(58) Field of Search ..... 368/76, 80, 223, 368/228, 232, 69

(56) References Cited

U.S. PATENT DOCUMENTS 4,421,420 A * 12/1983 Ushikoshi ..... 368/229
5,119,349 A * 6/1992 Muto et al. ..... 368/157
5,379,281 A * 1/1995 Koch ..... 368/72
5,440,527 A * 8/1995 Okamoto ..... 368/80
5,619,478 A * 4/1997 Mutoh ..... 368/72
5,673,238 A * 9/1997 Berney ..... 368/80
5,724,317 A * 3/1998 Kubota et al. ..... 368/11
6,327,226 B1 * 12/2001 Russi ..... 368/228
6,490,230 B1 * 12/2002 Sakuyama et al. ..... 368/11
6,580,665 B1 * 6/2003 Kamiyama et al. ..... 368/66
6,580,666 B2 6/2003 Yamaya

* cited by examiner

*Primary Examiner*—Vit W. Miska
(74) *Attorney, Agent, or Firm*—Carmody & Torrance LLP

(57) ABSTRACT

A method for indicating that a wearable electronic device is operating in a selected mode, wherein the wearable electronic device comprises at least one hand operatively coupled to an actuation mechanism. The method comprises the steps of (a) moving the hand from a first position to a second position, wherein the movement of the hand is through a predetermined sweep angle; (b) moving the hand from the second position back to the first position through the predetermined sweep angle; and (c) repeating at least step (a) and if necessary, repeating step (b); whereby the hand oscillates between the first position and the second position while the wearable electronic device is operating in the selected mode. A wearable electronic device that comprises the foregoing methodology is also provided.

22 Claims, 9 Drawing Sheets

WEARABLE ELECTRONIC DEVICE WITH MODE OPERATION INDICATOR

BACKGROUND OF THE INVENTION

This invention relates generally to wearable electronic devices, such as timepieces, and in particular a watch, that comprises unique constructions and methodologies for indicating that the wearable electronic device is operating in a selected mode. Generally speaking, the indication that the electronic device is in the selected mode is carried out by "waggling" or "oscillating" an indicator hand. The present invention is particularly applicable in, and advantageous when incorporated into, an electronic device of the type that displays information, such as time, with the use of hands, such as that found in analog watches (i.e. in an "analog manner"). In this application, the term "oscillate" shall be synonymous with "waggle."

By way of example and not limitation, the present invention is especially applicable to inform a user (or wearer of the device) when the device is in one or more selected modes, such as a timer mode, and as a particular example, such as a countdown or count-up timer mode. Such timer modes, whether they count down (15:00, 14:59, 14:58, 14:57, etc.) or up (i.e. 0:01, 0:02, 0:03, 0:04, . . . ), are particularly desirable to athletes in general and runners, cyclists and rowers in particular, since they allow the user to time their events or activities. Typically, such users use what are typically called "digital" watches, due to their incorporation of a LCD that can provide for immediate feedback on the operability of the device. Feedback on the operability of the watch or other device is usually achieved by actually seeing the displayed values change (e.g. "00:00"→"00:01"). In an analog watch, a user is likewise able to quickly glance at the display to see one or more hands move, which is the case, for example, on a chronograph mode, where the hand indicating seconds or fractions of a second is rotating relatively quickly.

That is, prior art methodologies in the same general field of endeavor can be found in chronograph watches, in which one or more of the smaller display hands rotate when in a timer mode, for example. Similarly, the second hand of a conventional watch can be seen to rotate in the clockwise direction in one-second intervals when in a normal run mode. What is important however is that the prior art is deficient in providing a suitable analogous indicator in an analog electronic device in which the timer indicator has a low resolution (e.g. one minute).

Moreover, in electronic devices that further the state of the art, such as those described in U.S. patent application Ser. No. 10/441,417, the mere use of a chronograph hand or a second hand would be less than satisfactory. For example, if the display hand is off to the side, as disclosed below, 360° rotation of the indicator hand may not be possible because of the construction and position thereof. Therefore, it is desired to provide yet an improved methodology and construction to indicate, by the use of one or more hands, that an electronic device is in a particular (e.g. selected) mode.

It is believed that the functionality and methodologies to provide the foregoing advantages and achieve the aforementioned objectives, as well as those set forth below, are provided by the present invention.

SUMMARY AND OBJECTIVES OF THE INVENTION

It is thus an objective of the present invention to overcome the perceived deficiencies in the prior art.

Specifically, it is an object of the present invention to provide an indicator, using a hand, that conveys to a user of an electronic device that the device is in a selected mode.

Another object of the present invention to provide an indicator, using a hand, that conveys to a user of an electronic device that the device is in a selected mode in a very user-friendly and fast manner.

Yet another object of the present invention to provide a user of an electronic device with immediate visual feedback that the device is in a selected mode, such as a timer mode, including information such as when the timer is started, in operation, and/or stopped.

Yet another object of the present invention is to provide an electronic device, such as a timepiece, that provides a user with suitable feedback of the operability of the device in a selected mode, when the hand movement has an otherwise low resolution.

Further objects and advantages of this invention will become more apparent from a consideration of the drawings and ensuing description.

The invention accordingly comprises the features of construction, combination of elements, arrangement of parts and sequence of steps that will be exemplified in the disclosure hereinafter set forth, and the scope of the invention will be indicated in the claims.

To overcome the perceived deficiencies in the prior art and to achieve the objects and advantages set forth above and below, the present invention is, generally speaking, directed to electronic devices, such as electronic timepieces in general and wristwatches in particular.

In a preferred embodiment, the method for indicating that a the electronic device is operating in a selected mode, wherein the wearable electronic device comprises at least one hand operatively coupled to an actuation mechanism, comprises the steps of: (a) moving the hand from a first position to a second position, wherein the movement of the hand is through a predetermined sweep angle; (b) moving the hand from the second position back to the first position through the predetermined sweep angle; and (c) repeating at least step (a) and if necessary, repeating step (b); whereby the hand oscillates between the first position and the second position while the wearable electronic device is operating in the selected mode. In specific features of the preferred embedment, the hand repeatedly sweeps through an arc that is less than $\pi/2$ radians. The method may also comprise the steps of (d) calibrating the hand so that the second position becomes a new first position; (e) moving the hand from the new first position to a new second position, wherein the movement of the hand is through a predetermined sweep angle; (f) moving the hand from the new second position back to the new first position through the predetermined sweep angle; and (g) repeating at least step (e) and if necessary, repeating step (f); whereby the hand oscillates between the new first position and the new second position while the electronic device is operating in the selected mode.

In a preferred construction, an electronic device is provided that is operable in a plurality of modes one of which is a selected mode, wherein the wearable electronic device includes at least one indicating hand for indicating that the electronic device is operating in the selected mode. Here the wearable electronic device preferably comprises a dial having a dial side and an actuation mechanism side; and the indicating hand is movable about an axis and positioned on the dial side of the dial; a controller for controlling the frequency of oscillation of the one indicating hand; an actuation mechanism, operatively coupled to the controller, for moving the indicating hand back and forth from a first position to a second position and from the second position back to the first position at the frequency, wherein the indicator hand oscillates between the first position and the second position while the electronic device is operating in the selected mode; whereby the movement of the indicating hand indicates that the wearable electronic device is operating in the selected mode.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, or steps, as the case may be, although not every feature or step in every figure may be called out with a reference numeral.

DESCRIPTION OF THE PREFERRED EMBODIMENTS

Figure 1:
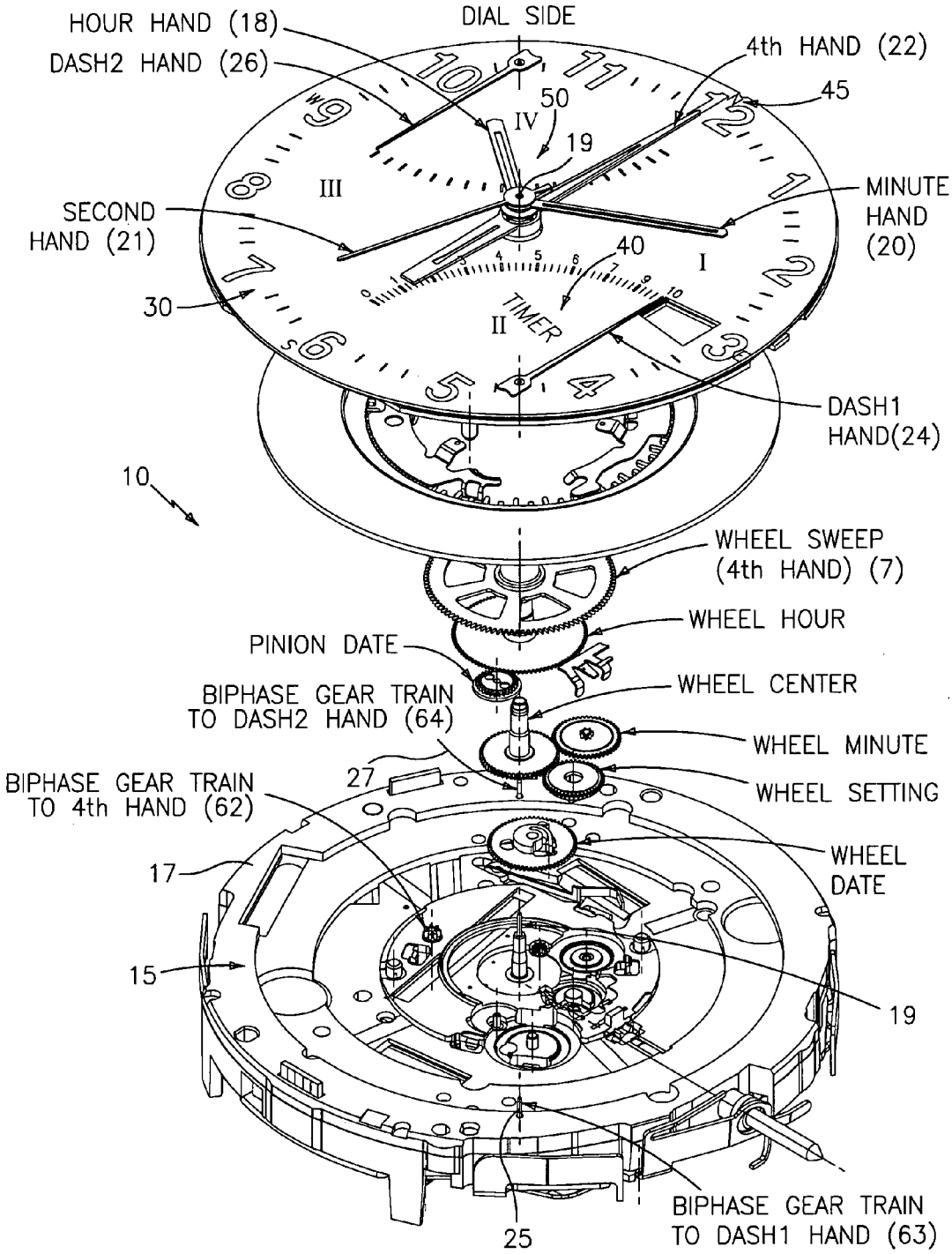
FIG. 1 is an exploded view of an electronic device constructed in accordance with the present invention.

Reference is first made generally to FIG. 1, which illustrates an exploded view of an electronic device, generally indicated at 10, constructed in accordance with the present invention. Many of the details of FIG. 1 will be omitted for purposes of brevity, but the reader is invited to read U.S. patent application Ser. No. 10/441,417 owned by the present assignee, which provides a description of all the details thereof. As this application Ser. No. 10/441,417 also provides many other non-essential details related to the present invention, the entire disclosure of this application Ser. No. 10/441,417 is incorporated by reference as if fully set forth herein.

Figure 2:
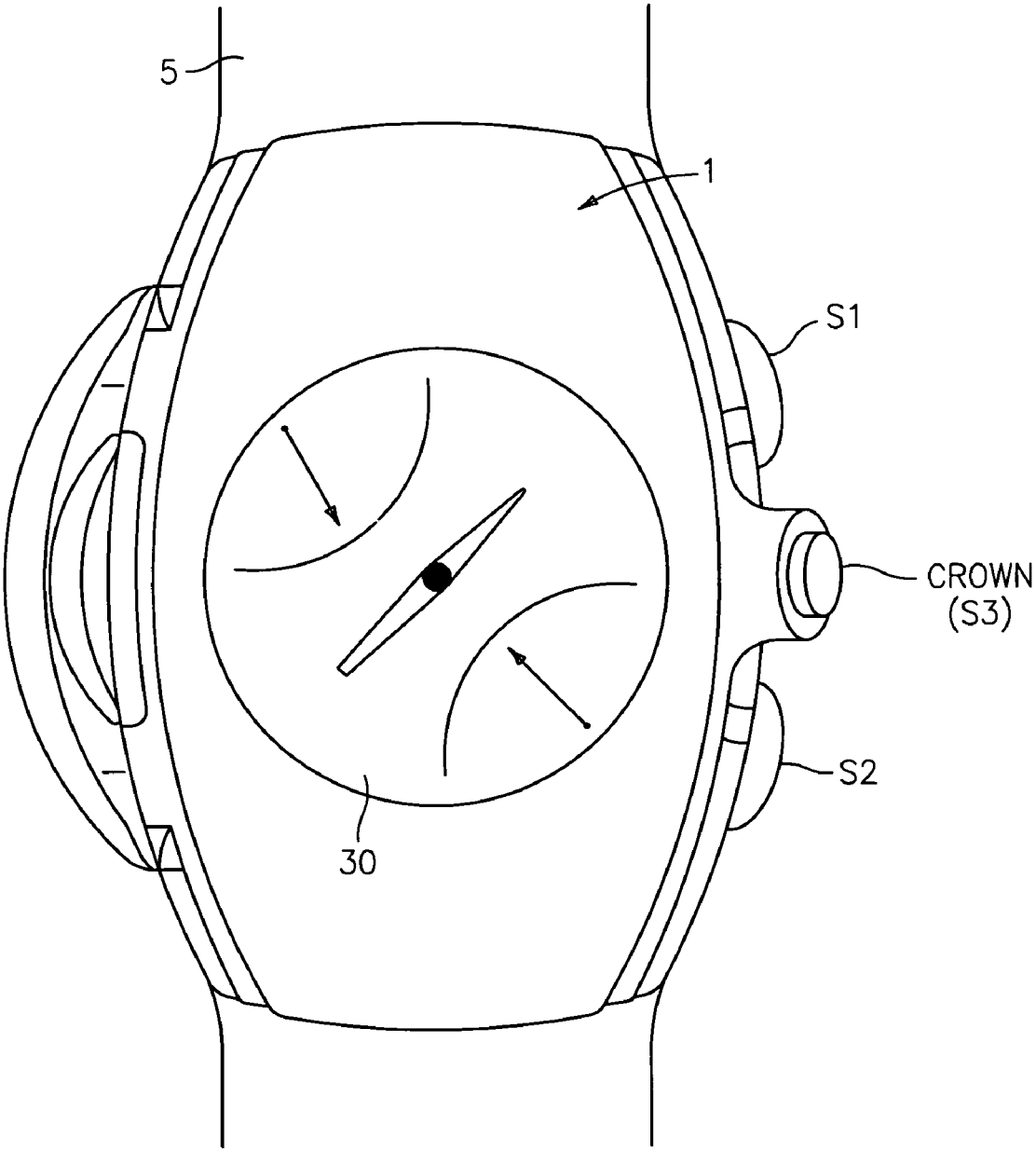
FIG. 2 is a top plan view of a wearable electronic device constructed in accordance with the present invention.

In a preferred embodiment, and as illustrated in FIG. 2, electronic device 10 is a wearable electronic device, such as but not limited to a wristwatch, generally indicated at 1, which itself will thus comprise other features and parts, namely for example and not limitation, a wrist strap 5 for securing electronic device 10 to a wrist.

Generally speaking, electronic device 10 comprises a module, generally indicated at 15, which itself includes a housing 17, in which are disposed many components, the material ones of which pertain to the present invention being hereinafter disclosed. However, it should be understood that the present disclosure will omit, for purposes of brevity, certain basic and very well known concepts regarding the construction of an analog or chronograph watch. For example, the basic construction and arrangements of gears and/or gear trains to rotate a plurality of "standard" hands all supported on a center stem 19, such as an hour hand 18, a minute hand 20 and a "seconds" hand 21, will be omitted as being well within the purview of one skilled in the art. Similarly, disclosure of the manual setting of such hands and the incorporation and construction of a preferred date wheel, are omitted herein as they form no part of the present invention.

As illustrated in FIG. 1, electronic device 10 comprises a dial, generally indicated at 30, made of Mylar or another suitable plastic. Dial 30 preferably has numerals, such as 1–12 corresponding to "hours" designations, printed, silk-screened or otherwise formed thereon. Other indicia to assist in telling time may also be provided on dial 30.

For purposes of describing the present invention, dial 30 may be thought of as being divided into quadrants. In this way, the electronic device construction illustrated in FIG. 1 can be seen to be provided with at least two other displays, the first being generally indicated at 40 and generally located in quadrant II, while another display area being generally indicated at 50 and generally located in quadrant IV. However, the locations of such display 40, 50 is one of design choice and only limited by the needed spacing for stepper motors and associated gear trains, since such displays could also be provided in opposing quadrants I & III, or in adjacent ones as well.

Figure 7A:
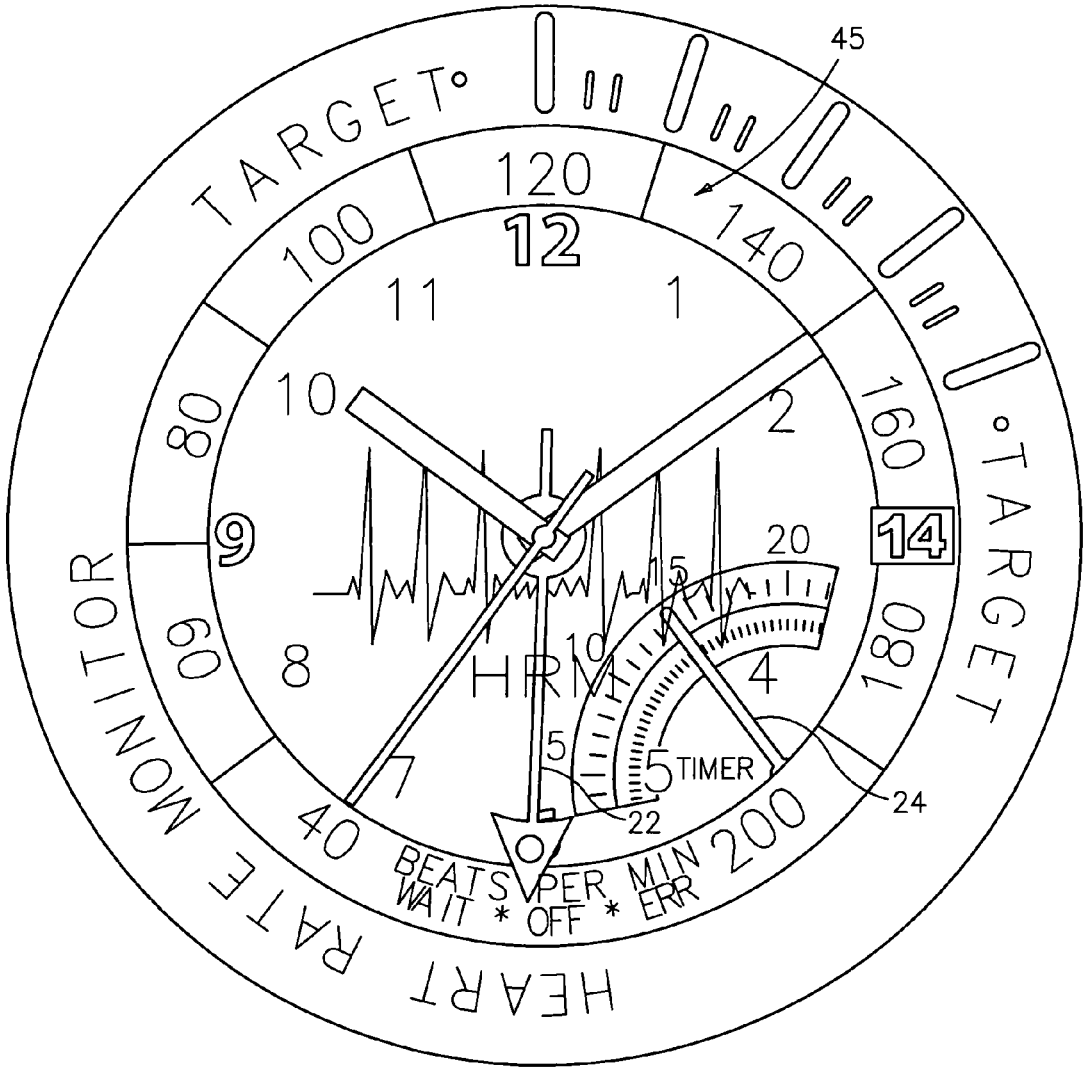
FIG. 7A is a top plan view of an electronic device constructed in accordance with a specific embodiment of the present invention, and 7B illustrates another exemplary timer display for the device depicted in FIG. 7A.

Yet another display may be provided on dial 30. This display is illustrated in FIG. 1, but more particularly illustrated in FIG. 7, and uses indicia provided on and about dial 30, such as for example, around the periphery thereof. This display will be denoted display 45, and is exemplary illustrated in FIG. 1 as being associated with compass directions, namely "N," "S," "E" and "W," and in FIG. 7 as being associated with a heart rate range from 40–200.

Preferably, each display 40, 45 and 50 has its own scale or other information indicia printed, silk-screened or otherwise provided on dial 30, and the demarcations of such scales are one of design choice and a function of the parameter(s) being measured or otherwise displayed, as discussed in greater detail below.

As can also be seen in FIG. 1, electronic device 10 may comprise one or more "display hands" aside from the conventional hour, minute and "seconds" hand. For example, FIG. 1 illustrates (i) a hand 22 also mounted on center stem 19 and associated with display 45, (ii) a hand indicated by the numeral 24 that is mounted on a stem 25 and associated with display 40 and (iii) a hand indicated by the numeral 26 that is mounted on a stem 27 and associated with display 50. Not all hands 22, 24 and 26 need to be provided in any specific embodiment.

For reference, it can be seen that the hour hand, the minute hand, the second hand and hand 22 are rotatable about a center axis, and display hands 24 and 26 are rotatable about an axis other than the center axis. This hand configuration permits the use of additional displays without the need to utilize any of the center-mounted hands, such as the hour and/or minute hands.

In accordance with a modification of the present invention, dial 30 may be provided with windows (not shown) in display areas 40 and 50. In such an embodiment, one or more LCD panels may be provided behind dial 30 and aligned with the respective windows. The use of such an LCD window is quite old in the art, and incorporated within watches coined "combo" watches. An exemplary construction of such an "analog/digital" or "combo" watch is described in U.S. Pat. No. 5,691,962, coowned by the present assignee and incorporated by reference as if fully set forth herein.

In such an embodiment, the LCD can display various scales that are particular to the desired displayable information. In this way, a single electronic device can be manufactured with many modes, and more pertinent to the present invention, the scales for a single mode (such as a timer mode as discussed herein) can vary as well, since one skilled in the art would know how to excite the appropriate LCD crystals to have a scale, grid or other measuring design appear on the LCD panels. The controller as disclosed below, can be programmed as would be known by one skilled in the art to maintain information regarding the mode, the scale appearing on LCD panel(s), and the position of the rotors for the respective stepping motors (as disclosed below), thereby coordinating control of the display and hand(s) such that any mode could be displayed by the use of differing displayable scales.

Figure 3:
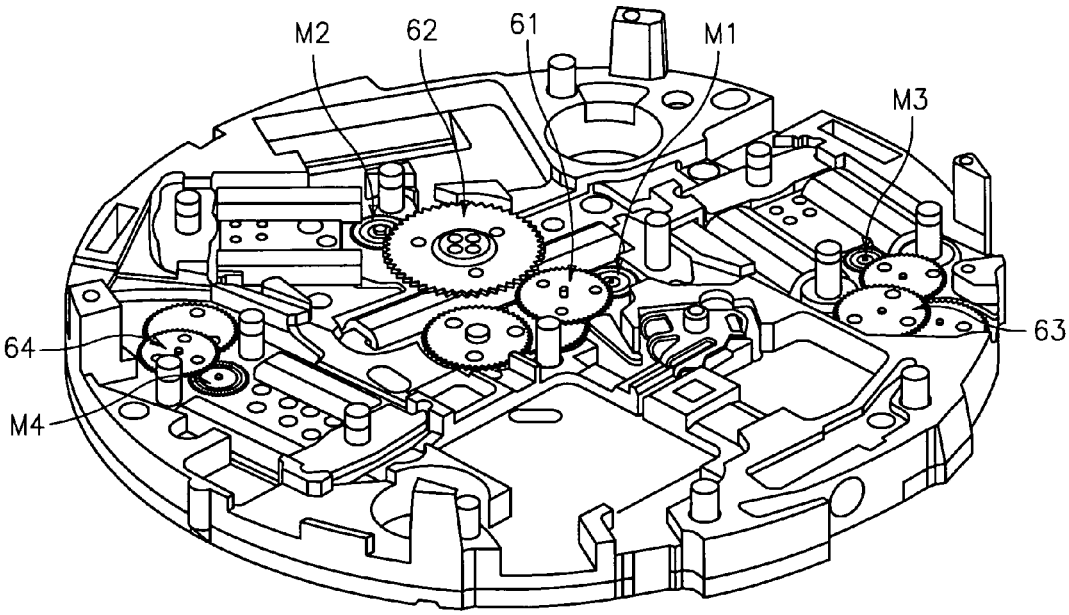
FIG. 3 is a perspective view of the underside of the electronic device illustrated in FIG. 1.

Reference is briefly made to FIG. 3, to more particularly illustrate the four stepper motors, each respectively and generally indicated by M1, M2, M3 and M4. One skilled in the art would recognize that varying the number of displays and display hands can vary the number of needed stepper motors, all of which is within the scope of the present invention and disclosure.

As positioned in module 15, motor M1 is provided to rotate hour hand 18, minute hand 20 and "seconds" hand 21 all in a known manner. Specifically, hour hand 18, minute hand 20 and "seconds" hand 21 are coupled to a gear train, generally indicated at 61, for conveying the rotational activity generated by the rotor of motor M1. In a similar manner, hand 22 is rotated by stepper motor M2, and a gear train generally indicated at 62 is provided to convey the rotational activity generated by the rotor of motor M2 to hand 22. Likewise, hands 24, 26 are each respectively rotated by stepper motors M3 and M4, and a gear train generally indicated at 63 is provided to convey the rotational activity generated by the rotor of motor M3 to hand 24, while a gear train generally indicated at 64 is provided to convey the rotational activity generated by the rotor of motor M4 to hand 26. The construction of the respective gear trains 61–64 are well within the purview of one ordinarily skilled in the art.

Preferably, motors M2, M3 and M4 are bi-directional stepper motors thus being able to rotate in either direction, with as many as two rotor steps per revolution (or 180° per rotor step), and the construction of acceptable stepper motors to functionally operate in this manner are widely commercially available and well within the understanding of those skilled in the art. Preferably, motors M2–M4 are identically constructed. It should also be understood that it is well within the skill of the designer to design an appropriate gearing ratio to provide for the desirable display rotation or movement of display hands 22, 24, 26. That is, it may be desirable for the incremental rotation of the hands to be quire small, thus providing for precise increments and display measurements. For example, in the preferred embodiments, where display hands 22, 24, 26 may need to move in precise increments, it is desirable to have very precise movement thereof, such as in 1.2° increments. Thus the ratio of the gear train from its associated motor to the display hands may be 150. In other examples, the ratio of the gear train from the respective motors may be 180, thus providing movement of the display hands in increments of 1°.

Figure 4:
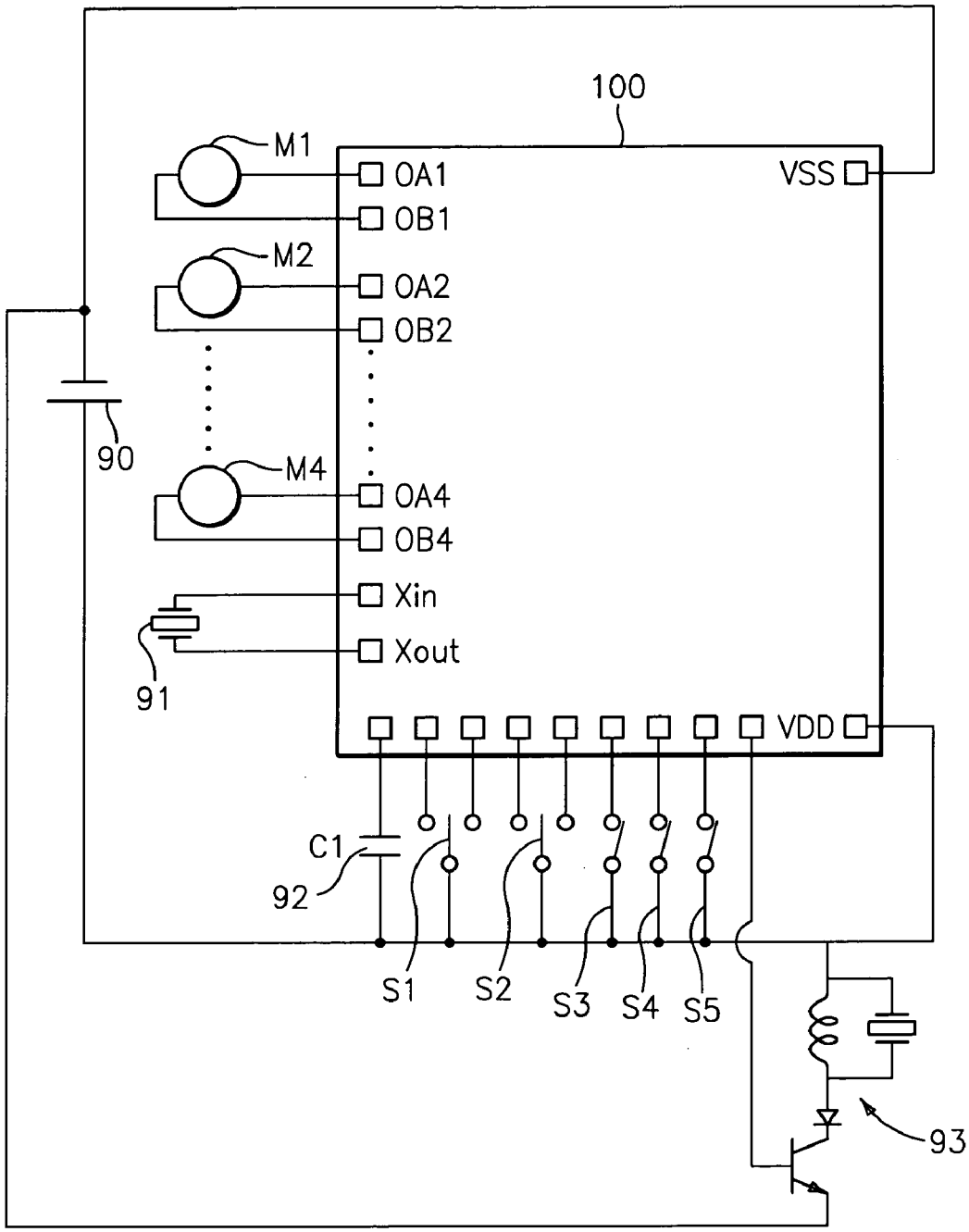
FIG. 4 is a circuit diagram for an electronic device constructed in accordance with the present invention.
Figure 5:
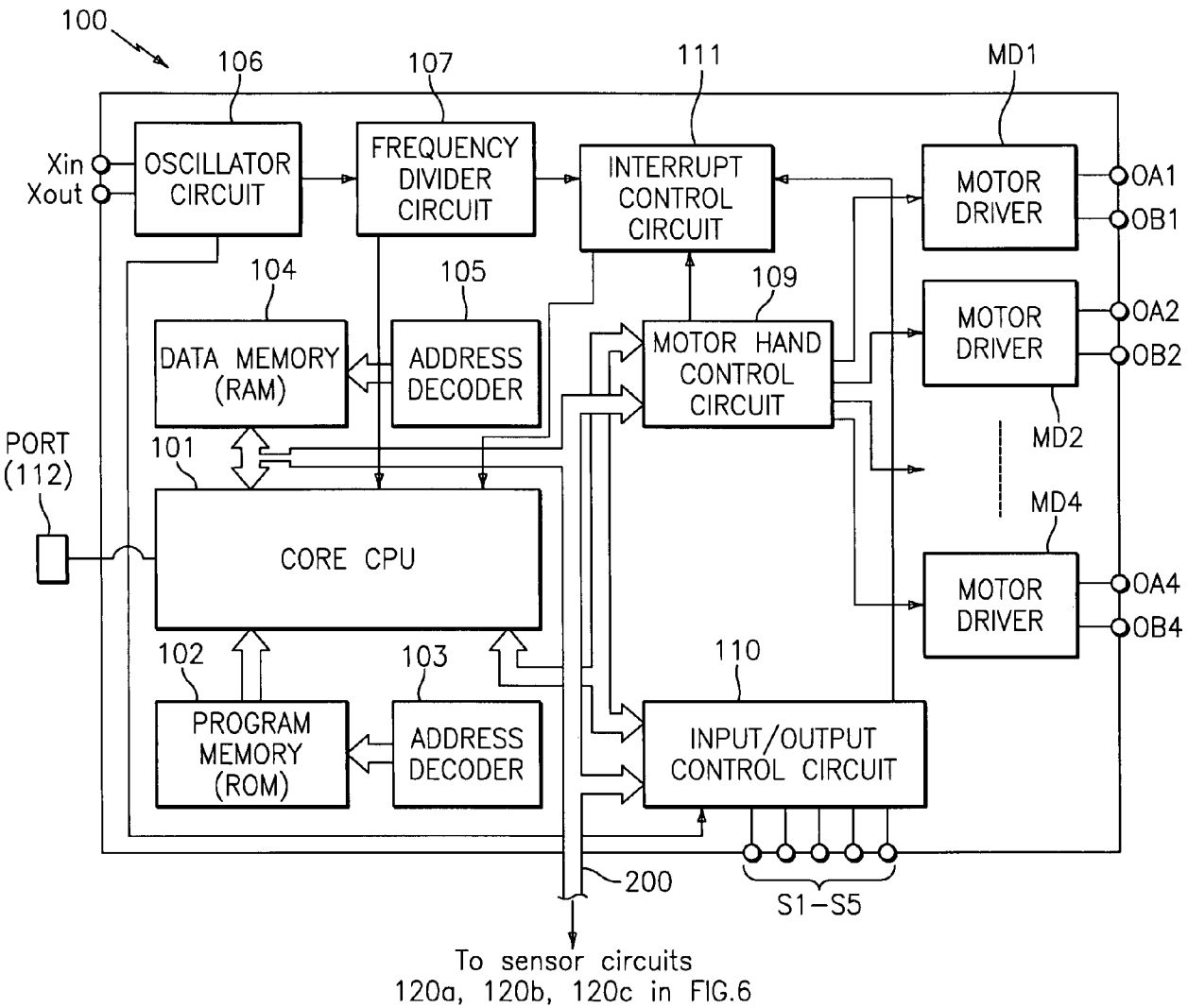
FIG. 5 is a block diagram of a controller, constructed in accordance with the present invention for use in an electronic device constructed in accordance with the present invention.
Figure 6:
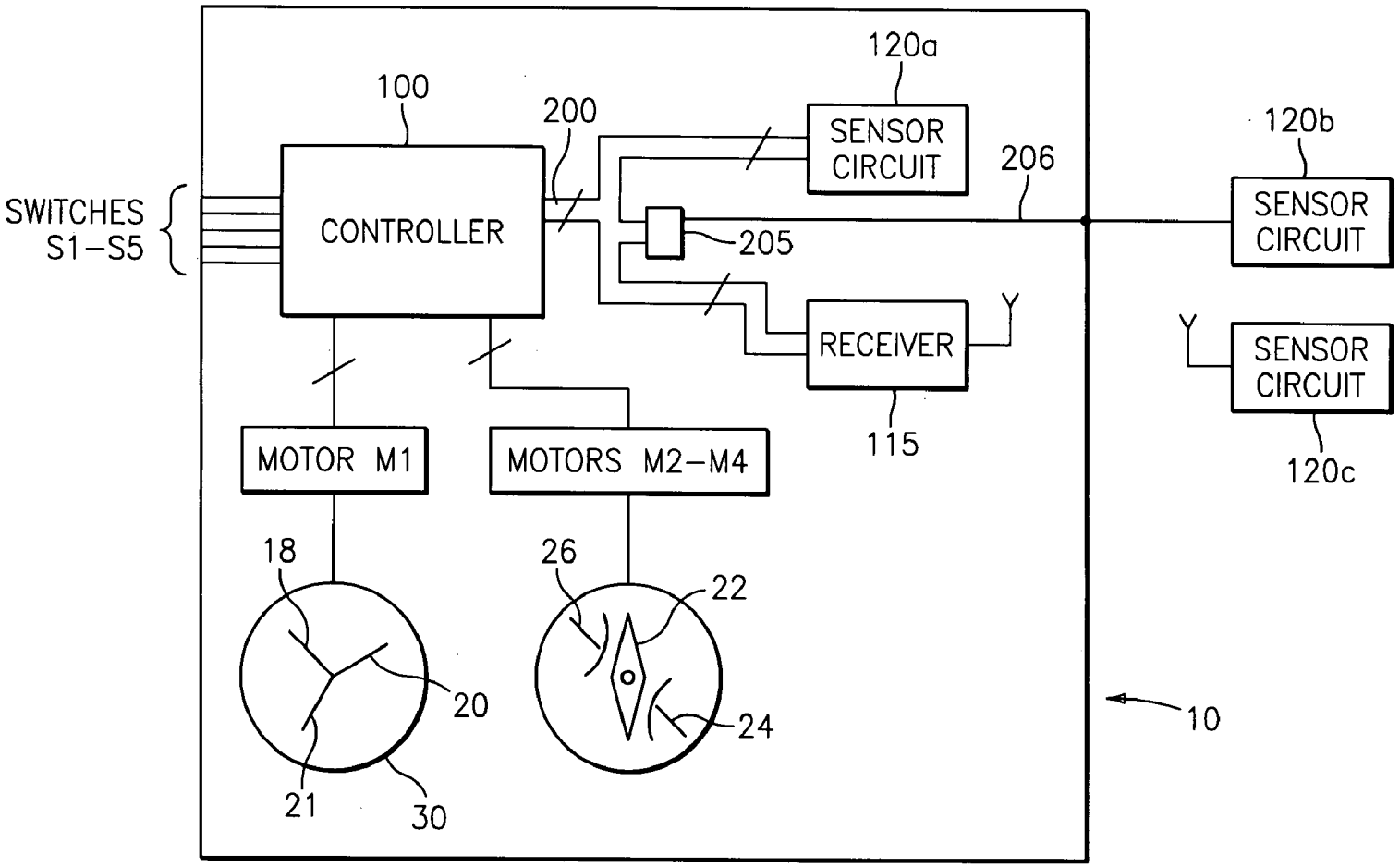
FIG. 6 is a block diagram showing certain other features and construction of an electronic device constructed in accordance with the present invention.

Reference is made briefly to FIG. 4–6, which illustrates circuit diagrams for a preferred construction of electronic device 10, details of which may be found in application Ser. No. 10/441,417. Generally speaking, controller 100 is preferably an integrated microcontroller typically used with electronic watches which, as will be more particularly disclosed below with reference to FIG. 5, integrates onto a single chip, and comprises a CPU core, a motor hand control circuit, an input/output control circuit, addressing and decoding functionality, memory and motor drivers.

As illustrated in FIG. 4, electronic device 10 includes, among other things, a battery 90, a resonator 91 to provide basic timing, a filter capacitor 92 and interface connections to motors M1–M4 and switches S1–S3, although more switches may be added as would be understood by one skilled in the art. A serial sensor interface may be provided for receiving data from a tethered sensor or wireless (remote) sensor. In addition, a well-understood circuit, generally indicated at 93, is provided for alarm activation.

By way of background, switches S1, S2, and S3 are intended to generically indicate both side/top mounted pushers, as well as side mounted rotatable crowns (see generic indications in FIG. 2), and thus respond to the actuation (i.e. pulling and/or pushing) action thereof. In the case of crowns, the pulling and or pushing actuations may be provided for setting hands 18, 20 and 21, setting alarm(s) and or actuating backlighting capabilities. In the case of side mounted pushers, start/stop functions such as for the below mentioned timers, mode selections and calibration of hands 22, 24 and 26 can be effectuated. Of course combinations of the foregoing are within the purview of one skilled in the art. Details of such side pushers or crown actuations/constructions are not material to the present invention, and therefore disclosure thereof is omitted.

Controller 100 comprises a core CPU 101 which itself comprises an ALU, a calculation register, a stack pointer, an instruction register and an instruction decoder. Controller 100 utilizes a memory mapped I/O bus 200 to communicate with hand control circuit 109, input output control circuit 110 and the sensor circuits.

A ROM memory block 102 in cooperation with an address encoder 103 provide access to electronic device control software and fixed data. The methodology for the programming for directing CPU 101 on the steps and logic necessary to keep track of and determine subsequent motor positions, is also coded into ROM 102. Reference may also be made to copending application Ser. No. 10/090,588, the subject matter of which is incorporated by reference as if set forth herein, for a disclosure of a preferred construction for driving and controlling a plurality of stepper motors.

A RAM memory block 104, in cooperation with an address decoder 105, provides storage for intermediate calculation values and also is used to hold current position of the various electronic device hands, such as hands 18, 20, 21, 22, 24 and 26, and to store changeable information that may be downloaded into controller 100 through a port, generically indicated by 112.

Controller 100 includes oscillator circuit 106 which oscillates at a frequency determined by resonator 91, and in the preferred embodiment, this frequency of oscillation is 32768 Hz. A frequency divider circuit 107 divides the output of oscillator circuit 106 to generate appropriate timing signals for timekeeping, motor control and data acquisition functions.

A motor hand control circuit 109 receives a commanded "next number of pulses" from CPU core 101 and generates the pulsed and phased signals necessary to move a desired motor (M1–M4) a desired amount and in a desired direction. Pulse outputs of the motor hand control circuit 109 are buffered by motor drivers MD1–MD4 and applied to motors M1–M4.

An input/output control circuit 110 controls the crown actuations and pushbutton switches of FIG. 3 and provides such signaling information to CPU 101.

An interrupt control circuit 111 is connected to frequency divider circuit 107, motor hand control circuit 109 and input/output control circuit 110, and outputs timer interrupts, motor control interrupts, and key interrupts to CPU 101.

Controller 100 directly or indirectly controls the movement of the respective hands including those for carrying out the objectives set forth herein. Electronic device 10 may also comprise one or more sensor circuits for measuring external parameters, and providing information to be displayed on electronic device 10. Such external parameters include, among others, heart rate, probably the most applicable to use in connection with the present invention. Again, U.S. application Ser. No. 10/441,417 describes and illustrates the particulars of the circuitry for appreciating such sensor functionality.

As noted, analog hands 18, 20 and 21 are preferably used to indicate time and hands 22, 24 and 26 are preferably used to display either values stored in ROM 102, values stored in RAM 104 or current data collected by sensors 120*a*, 120*b* or 120*c*. Advantageously, and as is also known to those skilled in the art, a stepper motor will remain in its last position unless pulsed to move. Therefore to smoothly display continuously varying information with an analog hand driven by a stepper motor, the preferred embodiment delivers to the stepper motor the necessary number of pulses to move the rotor of the stepper motor between a desired position at t=0, for example, and a position desired after some small time interval later.

FIG. 7 illustrates the use of display 40 being used as a timer, which could be a count-up timer or a countdown timer, with hand 24 being used to display the number of minutes elapsed or left, as the case may be. However, as alluded to above, the present invention provides for the programmability so that a user can set the desired number of minutes and/or scale for the countdown timer or count-up timer. Such information could be inputted through the use of one or more side or top pushers. A changing LCD can allow for multiple displays, with the controller being able to adjust the motor controls to accommodate differing scales and ranges of the timer display. For example, the number of actuations of a side pusher would cause controller 100 to cause motor hand control circuit 109 to step the appropriate rotor, here the rotor for motor M3, the proper number of steps to indicate additional minutes were selected for the countdown timer.

Therefore, turning to the specifics of the present invention, an advantageous feature is that one or more hands, such as hand 22, hand 26 or in the present illustrations, hand 24, may oscillate at some frequency, such as 1 Hz, when operating in the timer mode, to allow the user to know that the electronic device is actually operating in the timer mode (whether countdown or count up). Such a feature is achieved by rotating the rotor of the respective stepper motor, again, in the present illustration, motor M3, the appropriate number of pulses in the forward and reverse direction at the desired frequency while the timer is operational, all the while ensuring that controller 100 maintains information on the rotor position so that the proper rotation of the rotor can be effectuated after each minute of elapsed time.

Thus turning now specifically to FIGS. 8A–8D and FIG. 7B in connection with the following disclosure, the particulars of the present invention will now be described.

Generally speaking, the present invention is directed to a method for indicating that the electronic device is operating in a selected mode, and in the presently illustrated embodiment, it is hand 24 which will provide such indications. Specifically, the method is carried out by the steps of (a) moving the hand from a first position to a second position, wherein the movement of the hand is through a predetermined sweep angle, shown in FIG. 7B as ω; (b) moving the hand from the second position back to the first position through the predetermined sweep angle ω; and repeating at least step (a) and if necessary, repeating step (b). In this way, while in the selected mode, the hand, here hand 24, oscillates between the first position and the second position while the electronic device is operating in the selected mode.

Figure 7B:
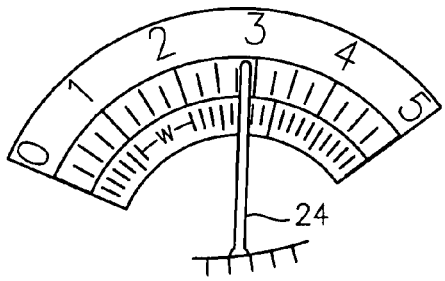

Using the particular example of FIG. 7B, one can see that the timer has been set for five (5) minutes, again whether it being a count up timer or a countdown timer is not material to the invention at this point. Important is the fact that one can customize the duration as desired (compare this five (5) minute setting to the twenty (20) minute setting of FIG. 7A). In any event, an object of the invention is to provide a method of indicating that a selected mode, here the timer mode, is operating. Without such an indication, a user would not know that the timer mode is operating until hand 24 moved another increment, such as a one-minute increment. Therefore, in accordance with the invention, an objective is to "waggle" or "oscillate" hand 24 at some rate to allow a user to easy and quickly see that the device is actually operating.

Figure 8D:
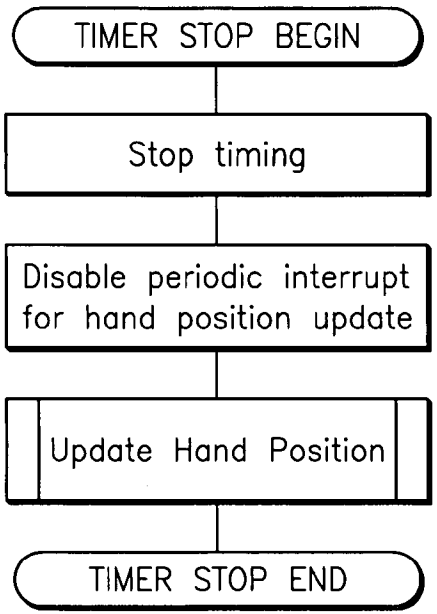
FIGS. 8A–8D are flowcharts of the preferred methodology for carrying out the present invention.
Figure 8B:
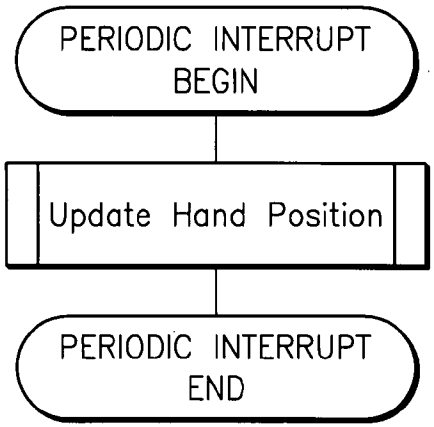
Figure 8A:
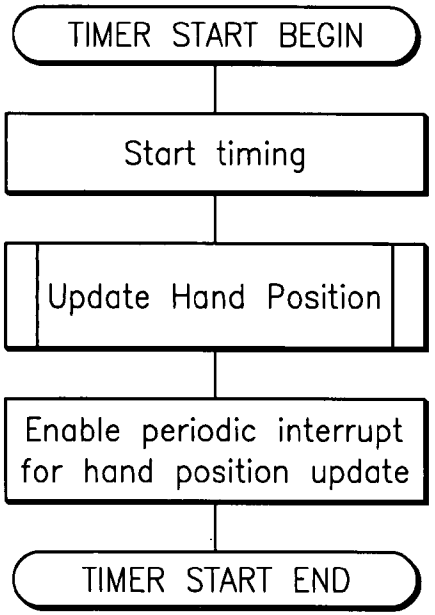

Therefore, reference is now made to FIG. 8A, which illustrates a preferred instruction sequence executed by controller 100 when the timer is started, typically by a switch actuation, such as the actuation of one or more switches S1–S3. Controller 100 includes means, through software and/or hardware, for periodically executing a sequence of instructions, which is represented by the "periodic interrupt" indication in FIG. 8A. Preferably, the interrupt is provided to update the indicating hand (e.g. hand 24) position at a frequency sufficient to convey to the user that the timer is running with a brief glance, as is an object of the invention, especially since the movement of hand 24 from the first position (e.g. "0" minutes) to the second position (e.g. "1" minute) would not otherwise occur for 1 minute, thereby being at a resolution too low for a quick glance to appreciate. FIG. 8B illustrates the instruction sequence executed by controller 100 when the periodic interrupt occurs, while FIG. 8D illustrates the instruction sequence executed by controller 100 when the timer is stopped, either manually, by switch actuation, or automatically by the timing circuitry of controller 100.

Figure 8C:
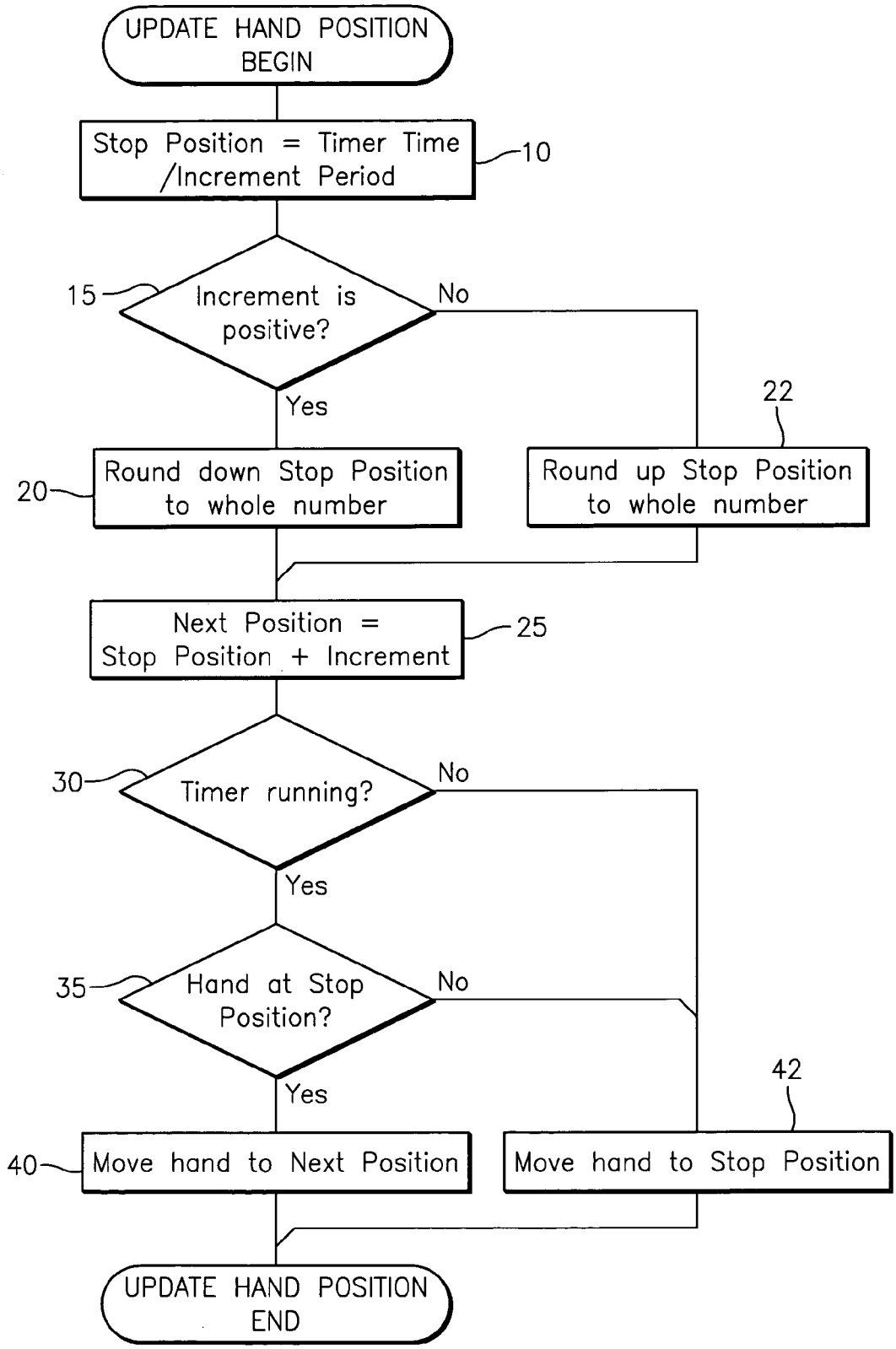

Reference will now be made in particular to FIG. 8C, which illustrates a preferred instruction sequence executed by controller 100 when updating the hand position in accordance with the present invention.

Specifically, after the selected function has been initiated (see "Timer Start" step in FIG. 8A) and it is necessary to update the hand position (see "Update Hand Position" step in FIG. 8B), control will pass to step 10 of FIG. 8C where the First Position is set. In the illustration of FIG. 7B, the initial First Position may be the zero ("0") position (count up) or the five ("5") position (countdown). As will become clear in a moment, the First Position is preferably updated by dividing the Timer Time (i.e. how long the timer has been functioning) by the Increment Period, determined and defined by the desired intervals on the display scale. In the exemplary embodiment, the Increment Period is sixty seconds (i.e. one (1) minute).

Control next passes to step 15 where it is determined whether the timer (as this is the selected mode in the preferred embodiment) is in a count-up mode or a countdown mode. Although where this step occurs is not material to the invention; its determination is important so the display can accurately illustrate whether the timer is counting up in minute increments, or counting down, such as from three (3) minutes to two (2). If the timer is counting up, then control would pass to step 20, while if the timer was counting down, control would pass to step 22. It should thus be understood that in a countdown mode, hand 24 is oscillating from the "3" position to the "2" position, and back and forth, and after expiration of the third minute, the hand will then move between the "2" position to the "1" position, as will be explained momentarily. On the other hand, if the timer is counting up, hand 24 is oscillating from the "2" position to the "3" position, and back and forth therebetween, and after expiration of the third minute, the hand will then move between the "3" position to the "4" position. FIG. 8C sets out the methodology for each alternative.

For example, control will then pass to step 25, where the "Second Position" is determined. At this point, it should be understood that during the first sixty (60) seconds of the count-up timer, First Position=0 (because until the Timer Time=60 seconds (assuming that the Increment Period=sixty (60) seconds)), and step 20 will maintain the First Position as equal to zero. However, step 25 will equate the Second Position equal to 1, since the Increment Period is one minute.

Thus with the timer being determined to be running (step 30) and in a count up mode, hand 24 will move to the Second Position (step 40) if it is at the First Position (i.e. from the "0" position to the "1" position), and will move back to the First Position (step 42) if it is at the Second Position (i.e. from the "1" position to the "0" position). At this point, the interrupt routine of FIG. 8C would terminate.

However, one skilled in the art will readily see that the interrupt routine of FIG. 8C will be entered again as long as the timer is still running. To be clear, once the Timer Time is greater than the Increment Period (as an example, the Timer Time equals 61 seconds), step 20 (in a count up timer) would set the new First Position as being the "1" position, while step 22 (in a countdown timer) would set the new first position as the "2" position.

In summary, one skilled in the art can see that for a count-up timer, hand 24 will oscillate between the "0" position and the "1" position until the expiration of the first Interval Period (e.g. 60 seconds), and thereafter oscillate between the "1" position and the "2" position until the expiration of the second Interval Period (e.g. the second minute). This routine will repeat (i.e. going next between the "2" position and the "3" position, etc.) until the Timer is terminated (e.g. using the switches).

On the other hand, in the countdown timer, hand 24 will oscillate between the "5" position and the "4" position until the expiration of the first Interval Period (e.g. 60 seconds), and thereafter oscillate between the "4" position and the "3" position until the expiration of the second Interval Period (e.g. the second minute), etc. Likewise, this routine of moving downwardly between the positions will repeat until the Timer terminates.

Lastly, if it is determined at step 30 that the timer is terminated, the preferred methodology moves the indicator hand to the First Position, thus placing the indicator hand to the position that best represents the current time elapsed when it is stopped. In this way, the methodology terminates the timer and moves the hand to the first position if the hand was previously positioned at the second position. Therefore, the method includes the steps of determining that the electronic device is no longer operating in the selected mode, and parking the hand at the first position. The step of parking the hand at the first position comprises the step of moving the hand from the second position back to the first position if the hand is not at the first position when the electronic device is determined to no longer be operating in the selected mode, or maintaining the hand at the first position if the hand is at the first position when the timepiece is determined to no longer be operating in the selected mode.

In the preferred embodiment, the indicator hand (e.g. hand 24), repeatedly sweeps through an arc that is less than $\pi/2$ radians. That is, the hand is preferably oscillating in small increments, and not, as performed in chronograph watches, around and around through 360°.

It can also be seen, from the example set forth above, that at the end of the Increment Period (e.g. one minute), the preferred methodology (d) calibrates the indicating hand so that the second position becomes a new first position (i.e. step 10); (e) moves the hand from the new first position to a new second position, wherein the movement of the hand is through a predetermined sweep angle, which may be the same as the prior angle $\omega$; (f) moves the hand from the new second position back to the new first position through the predetermined sweep angle; and (g) repeats at least step (e) and if necessary, repeats step (f). Here again, the hand will now oscillate between the new first position and the new second position while the wearable electronic device is operating in the selected (e.g. timer) mode.

Whether in a count-up mode or a countdown mode, the step of calibrating the hand so that the second position becomes a new first position preferably occurs after the passage of the Interval Period. Likewise, the step of moving the hand from the new first position to a new second position preferably occurs after the passage of the Interval Period, such as one (1) minute.

Similarly, the indicator hand 24 preferably oscillates between the first position and the second position at a predetermined oscillation rate, which in a preferred embodiment, is at a 1 Hz rate, although other faster or slower rates are certainly within the purview of one skilled in the art and are only limited by design choice and or the constraints of the particular components (such as the rotation rate of the rotor).

Lastly, provided that the electronic device comprises a dial on which there are numerical indicating indicia, and the second position is greater in numerical value than the first position, the method comprises the steps of: providing that if the selected mode is a countdown mode, then the numerical value associated with the first position is greater than the numerical value associated with the second position; and providing that if the selected mode is a count up mode, than the numerical value associated with the first position is less than the numerical value associated with the second position.

Accordingly, it can be seen that the present invention provides the ability to indicate that the electronic device is in any one of a plurality of selected modes by "waggling" or oscillating an indicator hand. As can be seen herein by example and not limitation, the present invention is particularly applicable in electronic devices, such as analog watches, that have one or more timer modes wherein the resolution of the timer hand is otherwise very low (e.g. one minute intervals). Specifically, by using the present invention, an indicator hand can effectively convey to a user of a wearable electronic device that the device is in a selected mode, such as a timer mode. Additionally, using the present invention provides a way to convey to the user that the device is in a selected mode in a very user-friendly and fast manner. Further, the present invention achieves the objective of providing immediate visual feedback that the device is in a selected mode, such as a timer mode, including information such as when the timer is started, in operation, and/or stopped which would otherwise not be shown by a hand that would otherwise only be moving every one minute, or in another relatively slow increment.

Lastly, it can be seen that the present invention can be provided by way of methodology and construction. That is, in its broadest sense, the preferred method comprises the steps of: (a) moving the hand from a first position to a second position, wherein the movement of the hand is through a predetermined sweep angle; (b) moving the hand from the second position back to the first position through the predetermined sweep angle; and (c) repeating at least step (a) and if necessary, repeating step (b); whereby the hand oscillates between the first position and the second position while the wearable electronic device is operating in the selected mode. Similarly, an electronic device that is operable in a plurality of modes one of which is a selected mode, wherein the wearable electronic device includes at least one indicating hand for indicating that the wearable electronic device is operating in the selected mode, is provided. In the preferred embodiment, the electronic device comprises a dial having a dial side and an actuation mechanism side; and the indicating hand is movable about an axis and positioned on the dial side of the dial; a controller for controlling the frequency of oscillation of the one indicating hand; an actuation mechanism, operatively coupled to the controller, for moving the indicating hand back and forth from a first position to a second position and from the second position back to the first position at the frequency, wherein the indicator hand oscillates between the first position and the second position while the wearable electronic device is operating in the selected mode; whereby the movement of the indicating hand indicates that the wearable electronic device is operating in the selected mode. In a specific embedment, the electronic device is a timepiece such as a wristwatch.

While the invention has been particularly shown and described with respect to preferred embodiments thereof, it will be understood by those skilled in the art that changes in form and details may be made therein without departing from the scope and spirit of the invention. For example, in the preferred embodiment, the hand moves back and forth one position (e.g. in one minute demarcations) while the timer is running. It should be understood that the hand could move back and forth more than one position (larger $\omega$), as would be advantageous if the movement of one position were not very noticeable by the user. Lastly, the frequency of oscillation can easily be varied from the preferred one (1) second intervals to a greater or lesser frequency.

What is claimed is:

1. A method for indicating that an electronic device is operating in a selected mode, wherein the electronic device comprises at least one hand operatively coupled to an actuation mechanism, the method comprising the steps of:

(a) moving the hand from a first position to a second position, wherein the movement of the hand is through a predetermined sweep angle;

(b) moving the band from the second position back to the first position through the predetermined sweep angle; and (c) repeating at least step (a) and if necessary, repeating step (b), wherein the hand oscillates between the first position and the second position while the electronic device is operating in the selected mode;

(d) calibrating the hand so that the second position becomes a new first position;

(e) moving the hand from the new first position to a new second position, wherein the movement of the hand is through a predetermined sweep angle;

(f) moving the hand from the new second position back to the new first position through the predetermined sweep angle; and (g) repeating at least step (e) and if necessary, repeating step (f), wherein the hand oscillates between the new first position and the new second position while the electronic device is operating in the selected mode.

2. The method as claimed in claim 1, wherein the hand repeatedly sweeps through an arc that is less than $\pi/2$ radians.

3. The method as claimed in claim 1, wherein the step of calibrating the hand so that the second position becomes a new first position occurs after the passage of an interval period of time.

4. The method as claimed in claim 3, wherein the interval period of time is one (1) minute.

5. The method as claimed in claim 1, wherein the step of moving the hand from the new first position to a new second position occurs after the passage of an interval period of time.

6. The method as claimed in claim 3, wherein the step of moving the hand between the new first position and the new second position occurs at about every one second.

7. The method as claimed in claim 5, wherein the step of moving the hand from the new second position back to the new first position occurs after the passage of the interval period of time.

8. The method as claimed in claim 7, wherein the interval period of time is 0.5 seconds.

9. The method as claimed in claim 1, wherein the hand oscillates between the first position and the second position at a predetermined oscillation rate.

10. The method as claimed in claim 1, wherein the electronic device comprises a dial on which there are numerical indicating indicia, and the second position is greater in numerical value than the first position, the method comprising the steps of:

providing that if the selected mode is a countdown mode, then:

the numerical value associated with the first position is greater than the numerical value associated with the second position; and providing that if the selected mode is a count up mode, than:

the numerical value associated with the first position is less than the numerical value associated with the second position.

11. The method as claimed in claim 1, comprising the steps of:

terminating a timer and moving the hand to the first position if the hand was previously positioned at the second position.

12. The method as claimed in claim 11, including the steps of:

determining that the electronic device is no longer operating in the selected mode; and parking the hand at the first position.

13. The method as claimed in claim 12, wherein the step of parking the hand at the first position comprises the step of:

moving the hand from the second position back to the first position if the hand is not at the first position when the electronic device is determined to no longer be operating in the selected mode, or maintaining the hand at the first position if the hand is at the first position when the electronic device is determined to no longer be operating in the selected mode.

14. The method as claimed in claim 1, wherein steps (b) and (c) occur without actuations of a pusher or a crown by a user.

15. An electronic device that is operable in a plurality of modes one of which is a selected mode, wherein the electronic device includes at least one indicating hand for indicating that the electronic device is operating in the selected mode, wherein the electronic device comprises:

a selector for selecting the selected mode, a dial having a dial side and an actuation mechanism side; and the indicating hand is movable about an axis and positioned on the dial side of the dial;

means for:

controlling the frequency of oscillation of the at least one indicating hand;

moving the hand from a first position to a second position through a first predetermined sweep angle, moving the hand from the second position back to the first position through the first predetermined sweep angle and again at least moving the hand from the first position to the second position, wherein the hand oscillates between the first position and the second position while the electronic device is operating in the selected mode;

calibrating the hand so that the second position becomes a new first position; and moving the hand from the new first position to a new second position through a second predetermined sweep angle, moving the hand from the new second position back to the new first position through the second predetermined sweep angle and again at least moving the hand from the new first position to the new second position, wherein the hand oscillates between the new first position and the new second position while the electronic device is operating in the selected mode;

whereby the movement of the indicating hand indicates that the electronic device is operating in the selected mode.

16. The electronic device as claimed in claim 15, wherein the means comprises a stepper motor that itself comprises a rotor, the stepper motor operatively coupled to the controller, for stepping in clockwise and counterclockwise directions in predefined increments while the electronic device is operating in the selected mode;

wherein the rotor of the stepper motor is operatively coupled to the at least one indicating hand, and wherein the rotation of the rotor causes the movement of the at least one indicating hand.

17. The electronic device as claimed in claim 16, wherein the indicator hand has a gear train operatively coupled thereto, wherein the rotational activity generated by the rotor of the stepper motor is conveyed to the gear train which in turn causes the rotation of the indicating hand.

18. The electronic device as claimed in claim 17, wherein the means comprises a motor hand control circuit and a central processing unit, and wherein the motor hand control circuit receives commands from the central processing unit regarding the number of increments and direction of rotation, and wherein the motor hand control circuit generates pulsed and phased signals for moving the rotor of the stepper motor a desired amount and in a desired direction.

19. The elect tonic device as claimed in claim 15, comprising:

at least an hour hand and a minute hand for conveying time of day information; and wherein the indicator hand rotates about an axis other than a center axis of the dial.

20. The electronic device as claimed in claim 15, wherein the electronic device is a wristwatch.

21. The electronic device as claimed in claim 16, wherein the stepper motor for moving the at least one indicator hand is not mechanically coupled to the hour hand or minute hand;

whereby the stepper motor can rotate the indicator hand independent of the time of day.

22. The electronic device as claimed in claim 16, wherein the stepper motor is bi-directional and the first predetermined sweep angle is at least essentially equal to the second predetermined sweep angle.

* * * * *